US007165937B2

(12) United States Patent
Dong et al.

(10) Patent No.: US 7,165,937 B2
(45) Date of Patent: Jan. 23, 2007

(54) METHODS AND APPARATUS FOR MAINTAINING ROTOR ASSEMBLY TIP CLEARANCES

(75) Inventors: Zhifeng Dong, Cincinnati, OH (US); Michael J. Epstein, Mason, OH (US); Glen William Royal, Cincinnati, OH (US); Robert J. Albers, Park Hills, KY (US)

(73) Assignee: General Electric Company, Schenectady, NY (US)

( * ) Notice: Subject to any disclaimer, the term of this patent is extended or adjusted under 35 U.S.C. 154(b) by 72 days.

(21) Appl. No.: 11/005,870

(22) Filed: Dec. 6, 2004

(65) Prior Publication Data

US 2006/0120860 A1 Jun. 8, 2006

(51) Int. Cl.
*F01D 11/08* (2006.01)
*F03B 11/02* (2006.01)

(52) U.S. Cl. ..... 415/173.2; 415/175; 415/177; 29/889.22

(58) Field of Classification Search ..... 415/108, 415/115, 116, 173.1, 173.2, 173.3, 175, 176, 415/177, 178; 29/889.2, 889.22
See application file for complete search history.

(56) References Cited

U.S. PATENT DOCUMENTS 2,859,934 A * 11/1958 Halford et al. ..... 415/115
3,982,850 A * 9/1976 Jenkinson ..... 415/178
3,990,807 A * 11/1976 Sifford ..... 415/136
4,069,662 A 1/1978 Redinger, Jr.
4,213,296 A 7/1980 Schwartz
4,247,247 A 1/1981 Thebert
4,257,222 A 3/1981 Schwarz
4,330,234 A 5/1982 Colley
4,573,866 A * 3/1986 Sandy et al. ..... 415/116
4,657,479 A 4/1987 Brown et al.
4,784,569 A 11/1988 Sidenstick
4,893,983 A 1/1990 McGreehan
4,893,984 A 1/1990 Davison et al.
5,018,942 A 5/1991 Ciokajlo et al.
5,035,573 A 7/1991 Tseng et al.
5,049,033 A 9/1991 Corsmeier et al.
5,054,997 A 10/1991 Corsmeier et al.
5,056,988 A 10/1991 Corsmeier et al.
5,096,375 A 3/1992 Ciokailo
5,104,287 A 4/1992 Ciokajlo
5,116,199 A 5/1992 Ciokajlo
5,154,575 A 10/1992 Bonner
5,211,534 A 5/1993 Catlaw
5,212,940 A 5/1993 Glover
5,456,576 A 10/1995 Lyon
5,584,651 A * 12/1996 Pietraszkiewicz et al. .. 415/115
5,685,693 A 11/1997 Sexton et al.
5,779,442 A 7/1998 Sexton et al.

(Continued)

*Primary Examiner*—Igor Kershteyn
(74) *Attorney, Agent, or Firm*—William Scott Andes; Armstrong Teasdale LLP

(57) ABSTRACT

A method enables a gas turbine engine to be assembled. The method comprises coupling a rotor assembly including a plurality of circumferentially-spaced rotor blades downstream from, and in flow communication with, a compressor, coupling a casing assembly circumferentially around the rotor assembly such that a clearance is defined between an inner shroud surface of the casing assembly and the rotor blade tips, and coupling a clearance control system to the casing assembly to facilitate maintaining the clearance between the casing assembly and the rotor blade tips, wherein at least a portion of an external surface of the clearance control system is formed with a textured pattern that facilitates increasing the clearance control closure capability during engine operation.

18 Claims, 4 Drawing Sheets

U.S. PATENT DOCUMENTS 5,906,473 A 5/1999 Sexton et al.
6,059,523 A * 5/2000 Modafferi et al. ..... 415/9
6,079,943 A 6/2000 Sexton et al.
6,082,963 A 7/2000 Sexton et al.
6,302,642 B1 * 10/2001 Nagler et al. ..... 415/116
6,341,677 B1 1/2002 Oliver et al.
6,368,054 B1 4/2002 Luca
6,454,529 B1 9/2002 Zearbaugh et al.
6,463,729 B1 10/2002 Magoshi et al.
6,508,623 B1 * 1/2003 Shiozaki et al. ..... 415/173.1
6,641,363 B1 * 11/2003 Barrett et al. ..... 415/116
6,692,222 B1 2/2004 Prinz et al.
6,925,814 B1 8/2005 Wilson et al.
6,968,696 B1 11/2005 Little
2002/0136631 A1 9/2002 Zearbaugh et al.
2003/0215323 A1 11/2003 Prinz et al.
2005/0050901 A1 3/2005 Little
2005/0076649 A1 4/2005 Little et al.
2005/0126181 A1 6/2005 Wilson et al.
2005/0149274 A1 7/2005 Finnigan et al.
2006/0120860 A1 6/2006 Dong et al.

* cited by examiner

METHODS AND APPARATUS FOR MAINTAINING ROTOR ASSEMBLY TIP CLEARANCES

BACKGROUND OF THE INVENTION

This invention relates generally to gas turbine engines, and more particularly, to methods and apparatus to control gas turbine engine rotor assembly tip clearances during rotor assembly operation.

Gas turbine engines typically include an engine casing that extends circumferentially around a compressor, and a turbine including a rotor assembly and a stator assembly. The rotor assembly includes at least one row of rotating blades that extend radially outward from a blade root to a blade tip. A radial tip clearance is defined between the rotating blade tips and a shroud attached to the engine casing.

During engine operation, the thermal environment in the engine varies and may cause thermal expansion or contraction of the rotor and stator assemblies. Such thermal growth or contraction may not occur uniformly in magnitude or rate. As a result, inadvertent rubbing between the rotor blade tips and the casing may occur or the radial clearances may be more open than the design intent. Continued rubbing between the rotor blade tips and engine casing may lead to premature failure of the rotor blade or larger clearances at other operating conditions which can result in loss of engine performance.

To facilitate optimizing engine performance and to minimize inadvertent rubbing between the rotor blade tips and an inner surface of the shroud, at least some known engines include a clearance control system. The clearance control system channels cooling air to the engine casing to facilitate controlling thermal growth of the engine casing and to thus, facilitate minimizing inadvertent blade tip rubbing. Such cooling air may be channeled from a fan assembly, a booster, or from compressor bleed air sources to impinge on the casing. The effectiveness of the clearance control system may be dependent upon the heat transfer coefficient of clearance control system components.

BRIEF DESCRIPTION OF THE INVENTION

In one aspect, a method of assembling a gas turbine engine is provided. The method comprises coupling a rotor assembly including a plurality of circumferentially-spaced rotor blades downstream from, and in flow communication with, a compressor, coupling a casing assembly circumferentially around the rotor assembly such that a clearance is defined between an inner shroud surface of the casing assembly and the rotor blade tips, and coupling a clearance control system to the casing assembly to facilitate maintaining the clearance between the casing assembly and the rotor blade tips, wherein at least a portion of an external surface of the clearance control system is formed with a textured pattern that facilitates maintaining the clearance.

In another aspect, a clearance control system for a gas turbine engine including a compressor, a fan assembly, and at least one turbine including at least one row of rotor blades is provided. The clearance control system includes an engine casing assembly that extends circumferentially around the turbine such that a clearance is defined between a tip of the turbine blades and the casing assembly, and a manifold for distributing cooling air. At least a portion of an external surface of the clearance control system includes a textured pattern that facilitates maintaining the clearance.

In a further aspect, a gas turbine engine is provided. The engine includes a compressor, a turbine downstream from and in flow communication with the compressor, an engine casing extending circumferentially around the compressor and the turbine, and a clearance control system. The turbine includes at least one row of circumferentially-spaced rotor blades. The clearance control system includes an engine casing assembly that extends circumferentially around the turbine such that a clearance is defined between a tip of the rotor blades and the casing assembly. At least a portion of an external surface of the clearance control system includes a textured pattern that extends across the external surface. The textured pattern facilitates the clearance control system maintaining the clearance.

DETAILED DESCRIPTION OF THE INVENTION

A clearance control system for a gas turbine engine that facilitates maintaining a clearance gap defined between static casing assemblies and adjacent rotating components is described below in detail. Cooling air supplied towards the static casing assemblies from the clearance control system can come from any source inside the engine according to design. For example, the cooling air may be channeled from, but is not limited to being bled from, a fan assembly, intermediate stages of a compressor, or the compressor discharge. In addition, the cooling air may also facilitate reducing disk thermal growth, which typically accounts for the majority of the total closure of blade tip clearances. Moreover, the clearance control system described in detail below facilitates tighter clearances during engine operation.

Figure 1:
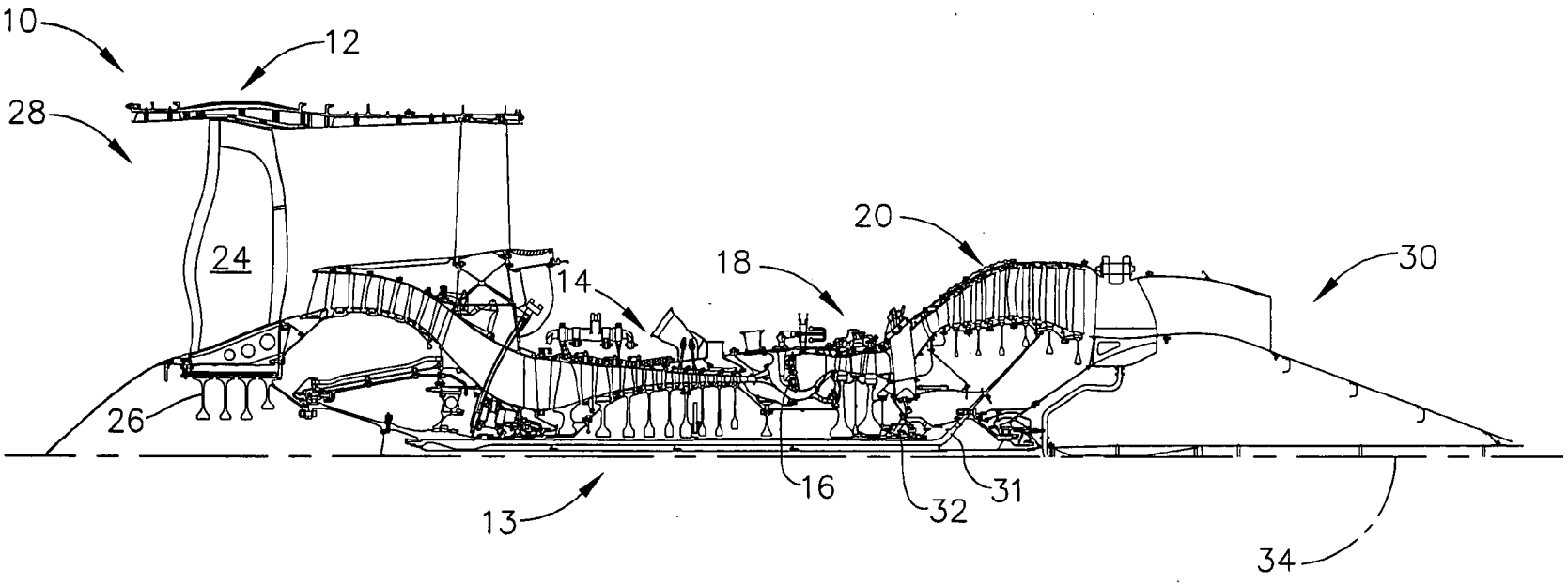
FIG. 1 is a schematic illustration of a gas turbine engine.

Referring to the drawings, FIG. 1 is a schematic illustration of a gas turbine engine 10 that includes, in an exemplary embodiment, a fan assembly 12 and a core engine 13 including a high pressure compressor 14, a combustor 16, and a high pressure turbine 18. Engine 10 also includes a low pressure turbine 20. Fan assembly 12 includes an array of fan blades 24 extending radially outward from a rotor disk 26. Engine 10 has an intake side 28 and an exhaust side 30. In one embodiment, the gas turbine engine is a GE90 available from General Electric Company, Cincinnati, Ohio. Fan assembly 12 and low pressure turbine 20 are coupled by a low speed rotor shaft 31, and compressor 14 and high pressure turbine 18 are coupled by a high speed rotor shaft 32.

During operation, air flows axially through fan assembly 12, in a direction that is substantially parallel to a central axis 34 extending through engine 10, and compressed air is supplied to high pressure compressor 14. The highly compressed air is delivered to combustor 16. Combustion gas flow (not shown in FIG. 1) from combustor 16 drives turbines 18 and 20. Turbine 18 drives compressor 14 by way of shaft 32 and turbine 20 drives fan assembly 12 by way of shaft 31.

Figure 2:
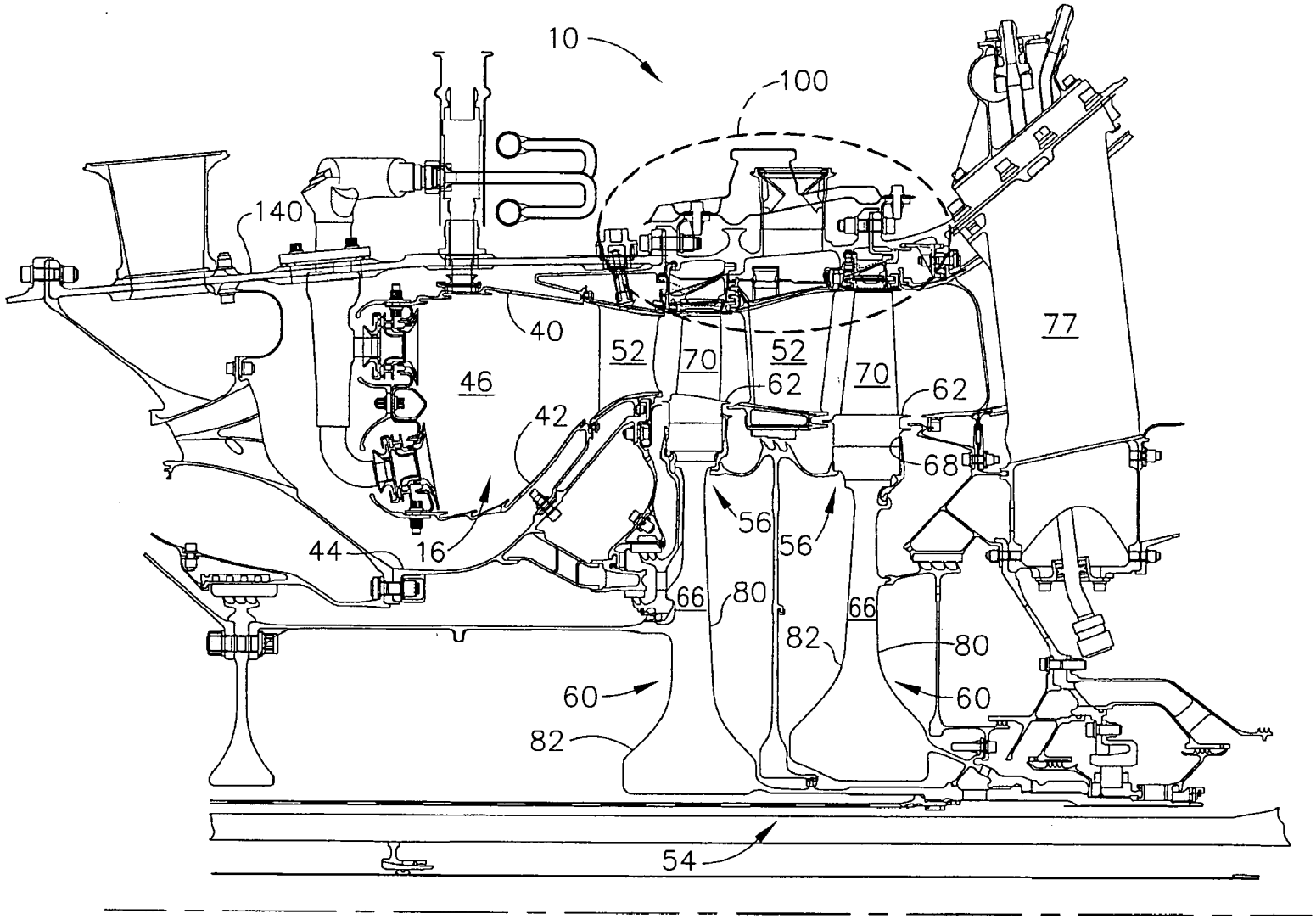
FIG. 2 is an enlarged sectional schematic illustration of a portion of the gas turbine engine shown in FIG. 1.
Figure 3:
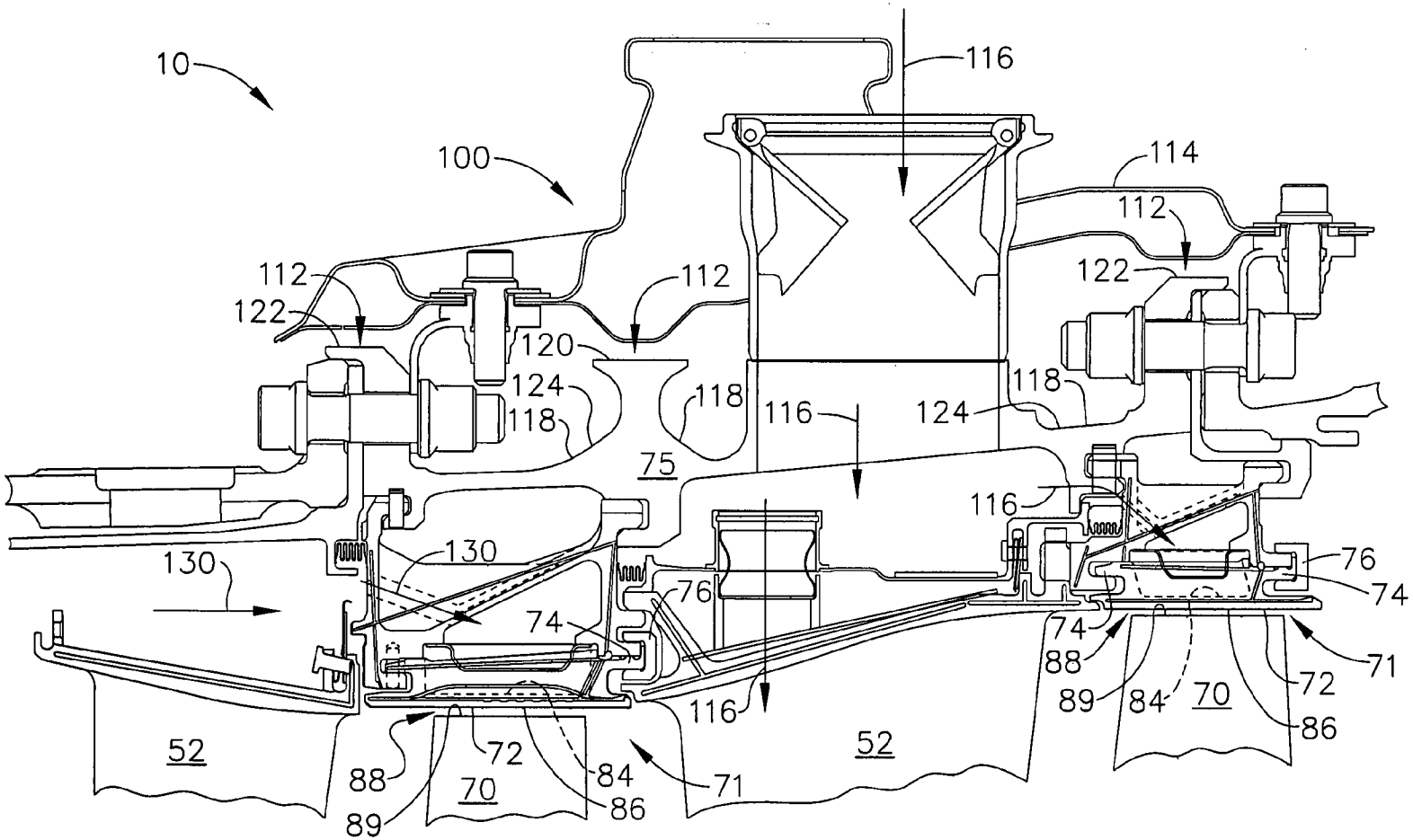
FIG. 3 is an enlarged sectional schematic illustration of a portion of a clearance control system shown in FIG. 2.

FIG. 2 is an enlarged sectional schematic illustration of a portion of gas turbine engine 10. FIG. 3 is an enlarged sectional schematic illustration of a portion of a clearance control system 100 shown in FIG. 2. In the exemplary embodiment, combustor 16 includes an annular outer liner 40, an annular inner liner 42, and a domed end (not shown) extending between outer and inner liners 40 and 42, respectively. Outer liner 40 and inner liner 42 are spaced radially inward from a combustor casing 140 and define a combustion chamber 46. In the exemplary embodiment, an inner nozzle support 44 is generally annular and extends forward from a stage 1 nozzle of high pressure turbine 18. Combustion chamber 46 is generally annular in shape and is defined between liners 40 and 42. Outer and inner liners 40 and 42 each extend to a turbine nozzle 52, of stage 1, that is coupled downstream from combustor 16.

High pressure turbine 18 is coupled substantially coaxially with, and downstream from, compressor 14 (shown in FIG. 1) and combustor 16. Turbine 18 includes a rotor assembly 54 that includes at least one rotor 56 that is formed by one or more disks 60. In the exemplary embodiment, disk 60 includes an outer rim 62, and an integral web 66 extending generally radially therebetween and radially inward from a respective blade dovetail slot 68. Each disk 60 also includes a plurality of blades 70 extending radially outward from outer rim 62. Disk 60 includes an aft surface 80 and an upstream surface 82.

Circumscribing the row of high pressure blades 70, and in close clearance relationship therewith, is an annular shroud or static casing assembly 71. Shroud assembly 71 is radially inward from a surrounding turbine casing 75. In the exemplary embodiment, shroud assembly 71 includes a plurality of shroud members or arcuate sectors 72 coupled to shroud hangers 74 and C-clip 76. Adjacent shroud members 72 are coupled together to circumscribe blades 70.

Each shroud member 72 includes a radially outer surface 84 and an opposite radially inner surface 86. A clearance gap 88 is defined between shroud inner surface 86 and tips 89 of rotor blades 70. More specifically, clearance gap 88 is defined as the distance between turbine blade tips 89 and an inner surface of turbine shroud 72.

Stationary turbine nozzles 52 are positioned between combustor 16 and turbine blades 70, and between the rows of turbine blades 70, if more than one turbine stage is involved. Nozzles 52 direct the combustion gases toward turbine blades 70 such that the impingement of combustion gases on blades 70 imparts a rotation of turbine disk 60. A turbine center frame 77 and a plurality of stationary stator vanes (not shown in FIG. 2) direct combustion gases passing through high pressure turbine blades 70 downstream to the low pressure turbine.

A clearance control system 100 facilitates controlling clearance gap 88 during engine operation. More specifically, in the exemplary embodiment, clearance control system 100 facilitates controlling gap 88 between rotor blade tips 89 and shroud member inner surfaces 86. Clearance control system 100 is coupled in flow communication to a cooling air supply source via a manifold 114. The cooling air exits manifold 114 and impinges on surfaces 120 and 122 extending from casing 75. The cooing air supply source may be any cooling air supply source that enables clearance control system 100 to function as described herein, such as, but not limited to, fan air, an intermediate stage of compressor 14, and/or a discharge of compressor 14. In the exemplary embodiment, cooling air 116 is bled from an intermediate stage of compressor 14 for stage 2 nozzles and shrouds cooling.

In the exemplary embodiment, manifold 114 extends circumferentially around turbine casing 75 and enables cooling air 112 to substantially uniformly impinge against surfaces 120 and 122. The thermal radial displacement of surfaces 120 and 122 facilitates limiting casing displacement, thus facilitating control of clearance gap 88. Casing 75 extends substantially circumferentially and includes at least some portions of external surface 118, i.e., see for example, surfaces 120, 122, and/or 124, that are positioned in flow communication with cooling air discharged from manifold 114. In one embodiment, surfaces 120 and 122 extend over portions of clearance control system 100 components such as, but not limited to, turbine casing, rings, and/or flanges.

At least a portion of an external surface 118 of turbine casing 75 is formed with a textured pattern (not shown in FIG. 2) that extends at least partially across external surface 118. For example, portions of surfaces 120, 122, and/or 124 may be formed with the textured pattern. In other embodiments, any portion of surface 118 that enables clearance control system 100 to function as described herein may be formed with a textured pattern. As is described in more detail below, the textured pattern increases the overall heat transfer effectiveness of external surface 118 and thus, facilitates increasing the closure capability of clearance control system 100.

During engine operation, compressor discharge pressure air 130 is channeled from compressor 14 towards shroud assembly 71 and clearance gap 88. In addition, cooling air 116 is directed through turbine casing 75 to facilitate cooling a stage 2 nozzle of turbine 18, and/or stage 2 shroud assembly 71, and/or to facilitate purging turbine middle seal cavities (not shown). The combination of cooling air 116 as well as external cooling of casing 75 facilitates enhanced control of clearance gap 88 and facilitates increasing the heat transfer effectiveness of casing surfaces 118, 120, and/or 122. The textured pattern extending at least partially across external surface 118 facilitates increasing the effective heat transfer, i.e., cooling, of surface 118 of clearance control system 100. As a result of the increased effective heat transfer of clearance control system 100, clearance gap 88 is facilitated to be more effectively maintained than is controllable through known clearance control systems. Moreover, the improved clearance gap control is achievable without increasing the amount of cooling air 112 and 116 supplied to clearance control system 100. As a result, turbine efficiency is facilitated to be increased while fuel burn is facilitated to be reduced.

Figure 4:
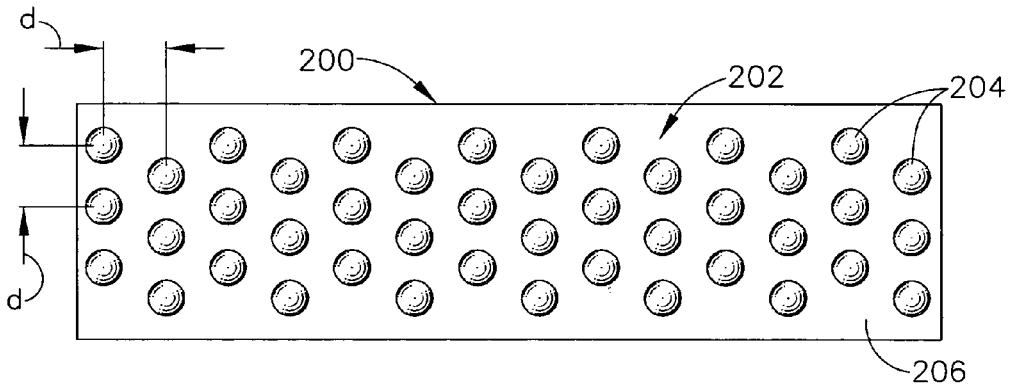
FIG. 4 is an enlarged plan-view of an exemplary static casing impingement surface that may be used with the gas turbine engine shown in FIG. 1.
Figure 5:
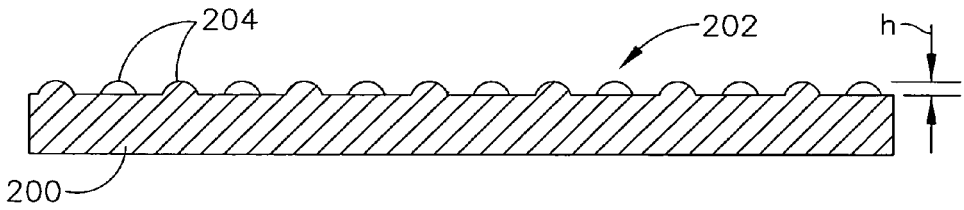
FIG. 5 is a cross-sectional view of the static casing shown in FIG. 4.

FIG. 4 is an enlarged plan view of an exemplary static casing impingement surface 200 that may be used with gas turbine engine 10 shown in FIGS. 1 and 2, and more specifically, with external surfaces 118, 120, and 122 of casing 75. FIG. 5 is a cross-sectional view of surface 200. Surface 200 is formed with a textured pattern 202 that in the exemplary embodiment, is defined by a series of rows of peaks 204 and valleys 206. More specifically, in the exemplary embodiment, peaks 204 are formed by convex, substantially-circular dimples that extend outward from surface 200, such that adjacent rows of dimples are spaced apart a substantially uniform distance d. In an alternative embodiment, the dimples are not circular. In another alternative embodiment, peaks 204 are not formed by dimples, but rather are formed by any shaped projection that enables impingement surface 200 to function as described herein. In a further alternative embodiment, peaks 204 are not arranged in rows or in pattern 202, but rather are arranged in other spaced-apart patterns that enable impingement surface 200 to function as described herein. Moreover, in another embodiment, pattern 202 is formed by concave, substantially-circular dimples that extend inward from surface 200. In such an embodiment, adjacent rows of dimples remain a distance d spaced apart.

In the exemplary embodiment, peaks 204 extend a height h away from surface 200, and extend across substantially all of impingement surface 200. In alternative embodiments, pattern 202 extends only partially across impingement surface 200. Accordingly, as should be appreciated by one of ordinary skill in the art, the overall size, shape, spacing of peaks 204 and valleys 206, as well as the orientation, pattern, and placement of peaks and valleys 206 may be variably selected depending on the application, within the spirit and scope of the claims.

The above-described clearance control system provides a cost-effective and reliable means for increasing the heat transfer effectiveness of the static casing assembly. More specifically, the textured surface of the impingement surface facilitates increasing the overall heat transfer area and heat transfer coefficients of the impingement surface and thus, facilitates increasing the heat transfer effectiveness of impingement surface. Therefore, the increased effective heat transfer of the impingement surface enables the associated static casing assembly to facilitate more effectively controlling the clearance gap without increasing the amount of cooling air supplied to the turbine casing. Thus, the clearance control system facilitates extending a useful life of the rotor assembly in a cost-effective and reliable manner.

An exemplary embodiment of a combustor casing is described above in detail. The casing illustrated is not limited to the specific embodiments described herein, but rather, components of each may be utilized independently and separately from other components described herein.

While the invention has been described in terms of various specific embodiments, those skilled in the art will recognize that the invention can be practiced with modification within the spirit and scope of the claims.

What is claimed is:

1. A method of assembling a gas turbine engine, said method comprising:

coupling a rotor assembly including a plurality of circumferentially-spaced rotor blades downstream from, and in flow communication with, a compressor;

coupling a casing assembly circumferentially around the rotor assembly such that a clearance is defined between an inner shroud surface of the casing assembly and the rotor blade tips; and coupling a clearance control system to the casing assembly to facilitate maintaining the clearance between the inner shroud surface of the casing assembly and the rotor blade tips, wherein the clearance control system includes a textured pattern formed on an external surface of at least a portion of the casing assembly to facilitate maintaining the clearance.

2. A method in accordance with claim 1 wherein coupling a clearance control system to the casing assembly further comprises coupling the clearance control system to the casing assembly such that the external surface textured pattern facilitates increasing heat transfer of the clearance control system during engine operation.

3. A method in accordance with claim 1 wherein coupling a clearance control system to the casing assembly further comprises coupling the clearance control system to the casing assembly to facilitate increasing the clearance control closure capability during engine operation.

4. A method in accordance with claim 1 wherein coupling a clearance control system to the casing assembly further comprises coupling the clearance control system to the casing assembly such that the external surface of the clearance control system includes a pattern formed of either a plurality of concave dimples or a plurality of convex dimples spaced across the impingement surface.

5. A method in accordance with claim 1 wherein coupling a clearance control system to the casing assembly further comprises coupling the clearance control system to the casing assembly such that the external surface textured pattern facilitates improving clearance closure capability during engine operation.

6. A clearance control system for a gas turbine engine including a compressor, a fan assembly, and at least one turbine including at least one row of rotor blades, said clearance control system comprising an engine casing assembly positioned in close proximity to the turbine such that a clearance is defined between a tip of the turbine blades and said casing assembly, and a manifold for distributing cooling air, at least a portion of an external surface of said engine casing assembly comprises a textured pattern that facilitates maintaining said clearance.

7. A clearance control system in accordance with claim 6 wherein said external surface textured pattern facilitates increasing a heat transfer coefficient of said clearance control system.

8. A clearance control system in accordance with claim 6 wherein said clearance control surface textured pattem facilitates increasing a heat transfer area said clearance control system.

9. A clearance control system in accordance with claim 6 wherein said clearance control surface textured pattern facilitates maintaining the clearance defined between said casing assembly and the turbine blades.

10. A clearance control system in accordance with claim 6 wherein said clearance control surface textured pattern comprises a plurality of concave dimples spaced across said external surface.

11. A clearance control system in accordance with claim 6 wherein said clearance control surface textured pattern comprises a plurality of convex dimples spaced across said external surface.

12. A clearance control system in accordance with claim 6 wherein said clearance control surface textured pattern facilitates improving turbine efficiency.

13. A gas turbine engine comprising:

a compressor;

a turbine downstream from and in flow communication said compressor, said turbine comprising at least one row of circumferentially-spaced rotor blades;

an engine casing extending circumferentially around said compressor and said turbine such that a clearance is defined between said turbine rotor blades and an inner shroud surface of said engine casing; and a clearance control system comprising a manifold for distributing cooling air, at least a portion of an external surface of said clearance control system comprises a textured pattern that extends across said external surface of said engine casing, said textured pattern facilitates said clearance control system maintaining said clearance.

14. A gas turbine engine in accordance with claim 13 wherein said clearance control system external surface textured pattern facilitates increasing the clearance closure of said clearance control system.

15. A gas turbine engine in accordance with claim 13 wherein said clearance control system external surface textured pattern facilitates improving turbine efficiency.

16. A gas turbine engine in accordance with claim 13 wherein said clearance control system external surface textured pattern facilitates increasing a heat transfer coefficient of said clearance control system.

17. A gas turbine engine in accordance with claim 13 wherein said clearance control system external surface textured pattern comprises a plurality of concave dimples spaced across said clearance control system external surface.

18. A gas turbine engine in accordance with claim 13 wherein said clearance control system external surface textured pattern comprises a plurality of convex dimples spaced across said clearance control system external surface.

* * * * *

UNITED STATES PATENT AND TRADEMARK OFFICE

CERTIFICATE OF CORRECTION

PATENT NO. : 7,165,937 B2
APPLICATION NO. : 11/005870
DATED : January 23, 2007
INVENTOR(S) : Dong et al.

It is certified that error appears in the above-identified patent and that said Letters Patent is hereby corrected as shown below:

In Claim 8, column 6, line 28, delete “pattem” and insert therefor -- pattern --.

Signed and Sealed this

Eighteenth Day of September, 2007

JON W. DUDAS
*Director of the United States Patent and Trademark Office*